US006386070B1

(12) United States Patent
Hong

(10) Patent No.: US 6,386,070 B1
(45) Date of Patent: May 14, 2002

(54) CONNECTING STRUCTURE FOR A HAMMERHEAD AND A GRIP

(75) Inventor: Lai-Chao Hong, Taichung (TW)

(73) Assignee: Chang Long Chen, Taichung Hsien (TW)

( * ) Notice: Subject to any disclaimer, the term of this patent is extended or adjusted under 35 U.S.C. 154(b) by 0 days.

(21) Appl. No.: 09/836,106

(22) Filed: Apr. 16, 2001

(51) Int. Cl.[7] ..... B25D 1/00
(52) U.S. Cl. ..... 81/20; 81/489; 16/110.1
(58) Field of Search ..... 81/20, 22, 177.1, 81/489; 16/110.1

(56) References Cited

U.S. PATENT DOCUMENTS 5,099,724 A * 3/1992 Reddy, Jr. ..... 81/20
5,926,911 A * 7/1999 Chen ..... 81/177.1 X
6,295,902 B1 * 10/2001 Lin ..... 81/20 X

* cited by examiner

*Primary Examiner*—James G. Smith
(74) *Attorney, Agent, or Firm*—Pro-Techtor International Services

(57) ABSTRACT

Connecting structure for a hammerhead and a grip. The grip is made by plastic injection molding and formed with a tunnel in which a connecting bar of the hammerhead is inserted. A wedge retainer is fitted from rear end of the grip into the tunnel and then the connecting bar of the hammerhead is inserted into a split of the wedge retainer and retained therein. Therefore, the connecting bar of the hammerhead is easily and firmly connected with the grip by the wedge retainer.

5 Claims, 7 Drawing Sheets

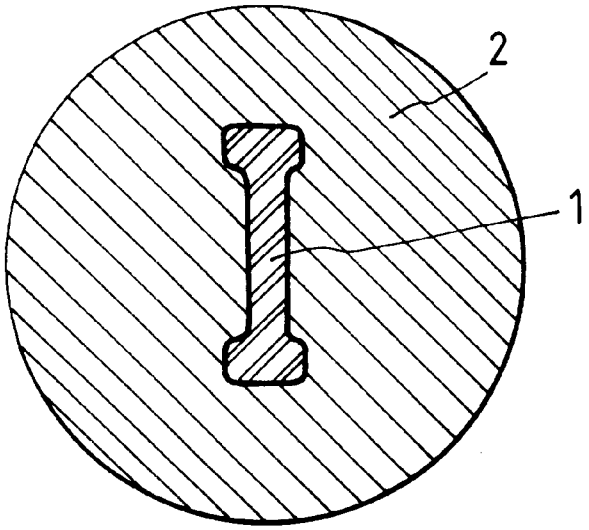
FIG,1
PRIOR ART
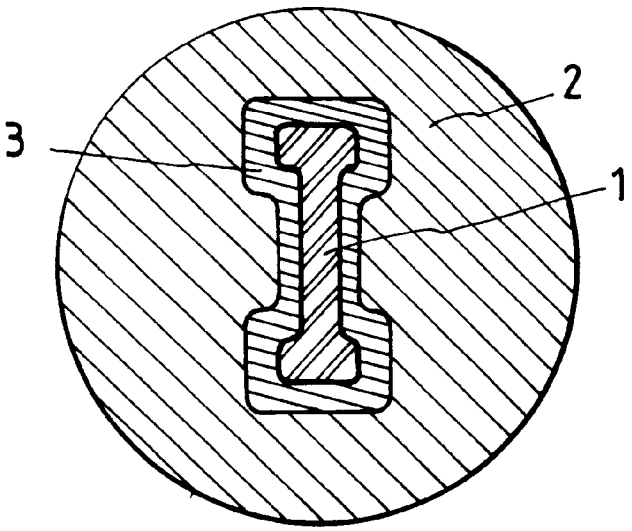
FIG,2
PRIOR ART

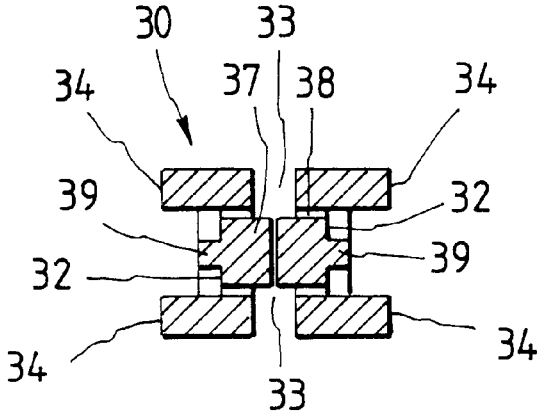
FIG,11
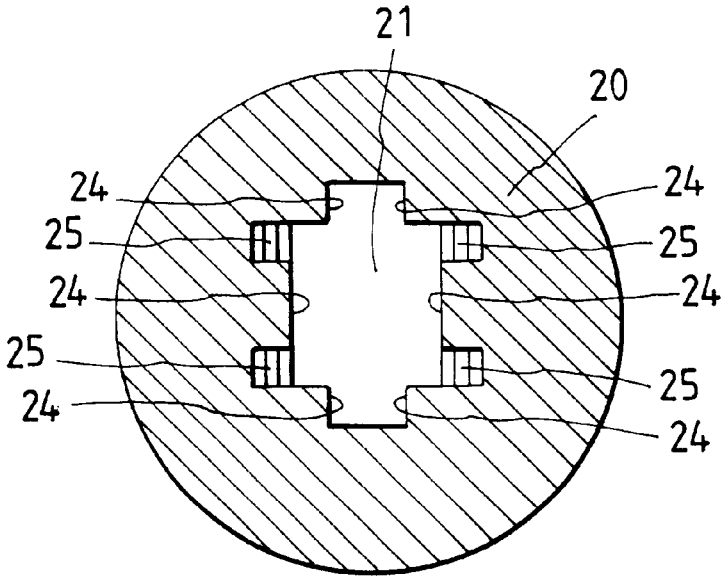
FIG,7

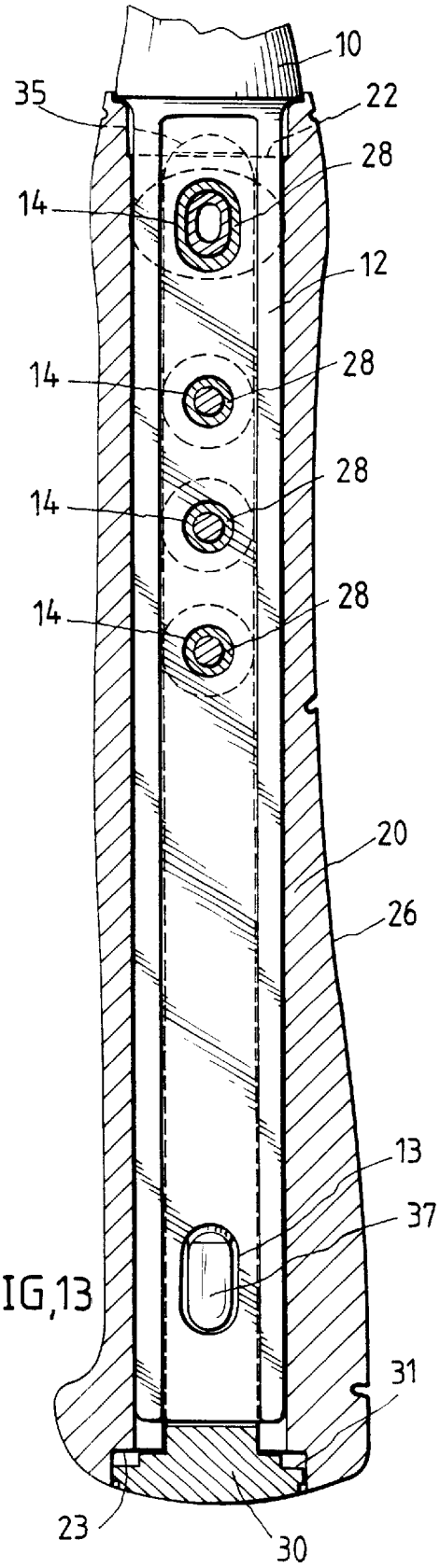
FIG,13
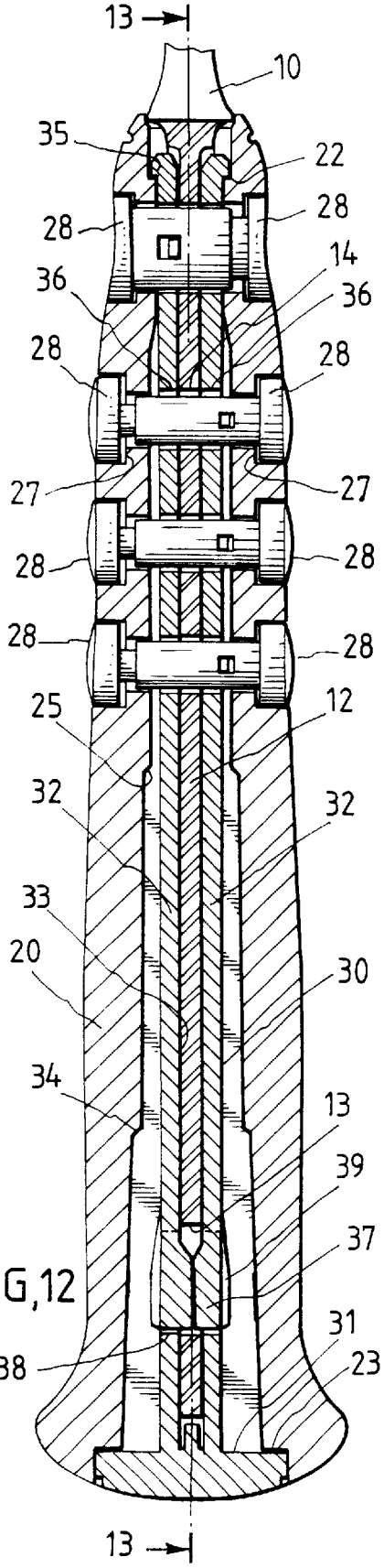
FIG,12

CONNECTING STRUCTURE FOR A HAMMERHEAD AND A GRIP

BACKGROUND OF THE INVENTION

The present invention is related to a connecting structure for easily and firmly connecting a hammerhead with a grip.

FIG. 1 is a cross-sectional view showing a conventional structure for connecting a handle of a hammer with a grip. The handle 1 of the hammer has an I-shaped cross-section for enhancing the strength thereof. The measures for connecting the handle 1 with the grip 2 can be divided into two types. One is to directly enclose the handle 1. The forged I-shaped handle 1 is placed into the mold for injection molding of the grip 2 and directly enclosed by the injected material of the grip 2. Accordingly, the handle 1 of the hammer and the grip 2 are integrally connected. The other is to insert the handle 1 into the grip 2. The grip 2 is molded with a tunnel. An adhesive is painted onto the inner wall face of the tunnel and the handle 1 is inserted into the tunnel 2 and adhered to the grip 2.

The above two measures have their own advantages and imperfections. With respect to the former, the advantage is that a better firmness can be achieved. However, the imperfection is that it is time-consuming to connect the handle with the grip, the mold is complicated and the cost is relatively high. With respect to the latter, the advantage is that it is easy to connect the handle with the grip, the mold has simple structure and the cost is relatively low. The imperfection is that the connection is poor and the handle is likely to detach from the grip. Moreover, the ratio of defective products resulting from human error is relatively high. The common shortcoming of both is that the grip 2 is made of plastic material which has not so high hardness for enhancing frictional coefficient to facilitate holding. In addition, the grip 2 has a certain diameter for a user's hand to hold. The handle 1 of the hammer is made by forging and has a limited width. Accordingly, the grip 2 and the handle 1 of the hammer are considerably different in dimension. As a result, when operating the hammer, the hammerhead tends to swing. It makes the user have to hold the grip with greater force when working with the hammer.

When connecting the handle 1 of the hammer with the grip 2, with respect to both the above two measures, a stabilizing layer 3 can be added between the grip 2 and the handle 1 to reduce the thickness of the grip 2 as shown in FIG. 2. The stabilizing layer 3 is made of harder plastic material to eliminate the swinging and facilitate holding. However, the stabilizing layer 3 is added into the mold during molding of the grip 2 or adhered to the grip 2 after molded. This will inevitably increase the manufacturing cost.

SUMMARY OF THE INVENTION

It is therefore a primary object of the present invention to provide a connecting structure for a hammerhead and a grip. A wedge retainer is fitted into a tunnel of the grip and then the connecting bar of the hammerhead is inserted into a split of the wedge retainer and retained therein. By means of the wedge retainer, the connecting bar of the hammerhead is easily and firmly connected with the grip. In addition, the wedge retainer compacts the tunnel of the grip so that a user can more truly hold the grip to facilitate operation of the hammer.

It is a further object of the present invention to provide the above connecting structure in which the front ends of the grip and the wedge retainer are respectively formed with stepped holes and through holes, retaining bolts being transversely passed through the stepped holes of the grip and the locating holes of the connecting bar and the through holes of the wedge retainer and locked thereon. Therefore, the connecting bar is more firmly connected with the grip, a holding section of rear portion of the grip is free from any retaining bolt so that a user can more easily and comfortably hold the grip. The surface of the retaining bolt can be marked with manufacturer's brand, whereby the brand can be changed by means of replacing the retaining bolt. Therefore, the design of the surface of the grip can be unified and the brand can be changed without varying the grip structure.

The present invention can be best understood through the following description and accompanying drawings wherein:

BRIEF DESCRIPTION OF THE DRAWINGS

FIG. 1 is a cross-sectional view of a conventional hammer handle and grip;

FIG. 2 is a cross-sectional view of another type of conventional hammer handle and grip;

FIG. 7 is a radially sectional view of the grip of FIG. 6;

FIG. 11 is a cross-sectional view of the wedge retainer of FIG. 9;

FIG. 12 is sectional assembled view of the present invention; and

FIG. 13 is a longitudinally sectional assembled view according to FIG. 12.

DETAILED DESCRIPTION OF THE PREFERRED EMBODIMENT

Figure 3:
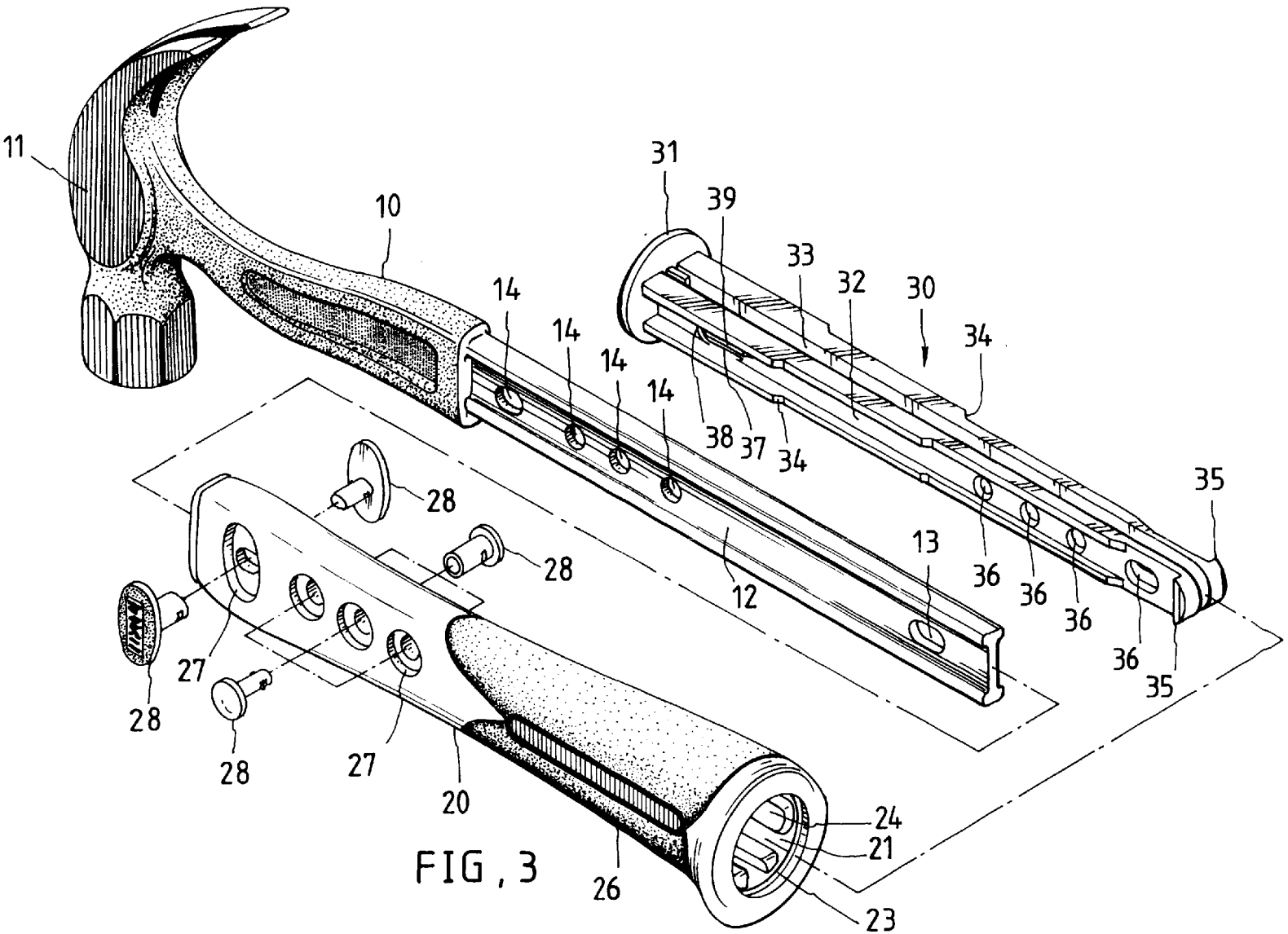
FIG. 3 is a perspective exploded view of the present invention.

Please refer to FIG. 3. The connecting structure for a hammerhead and a grip of the present invention includes a hammerhead 10 formed by forging and a grip 20 made by plastic integral injection molding. The hammerhead 10 has a hammering end 11 and a connecting bar 12 extending from the hammering end 11. The connecting bar 12 has a substantially I-shaped cross-section. The rear end of the connecting bar 12 is formed with a locating hole 13 passing through the connecting bar 12. The other end of the connecting bar 12 near the hammering end 11 is also formed with several locating holes 14 passing through the connecting bar 12.

Figure 4:
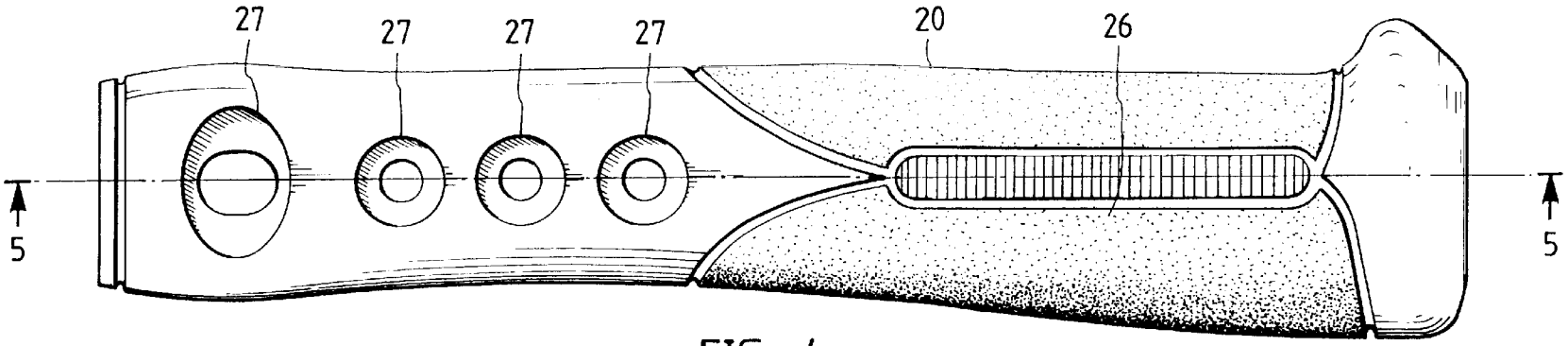
FIG. 4 is a plane view of the grip of the present invention.
Figure 5:
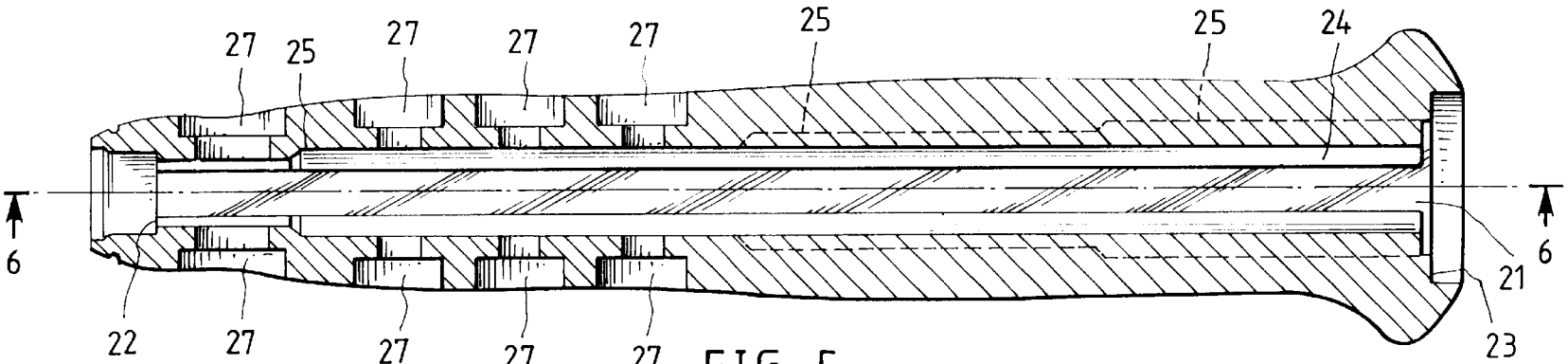
FIG. 5 is an axially sectional view of the grip of FIG. 4.
Figure 6:
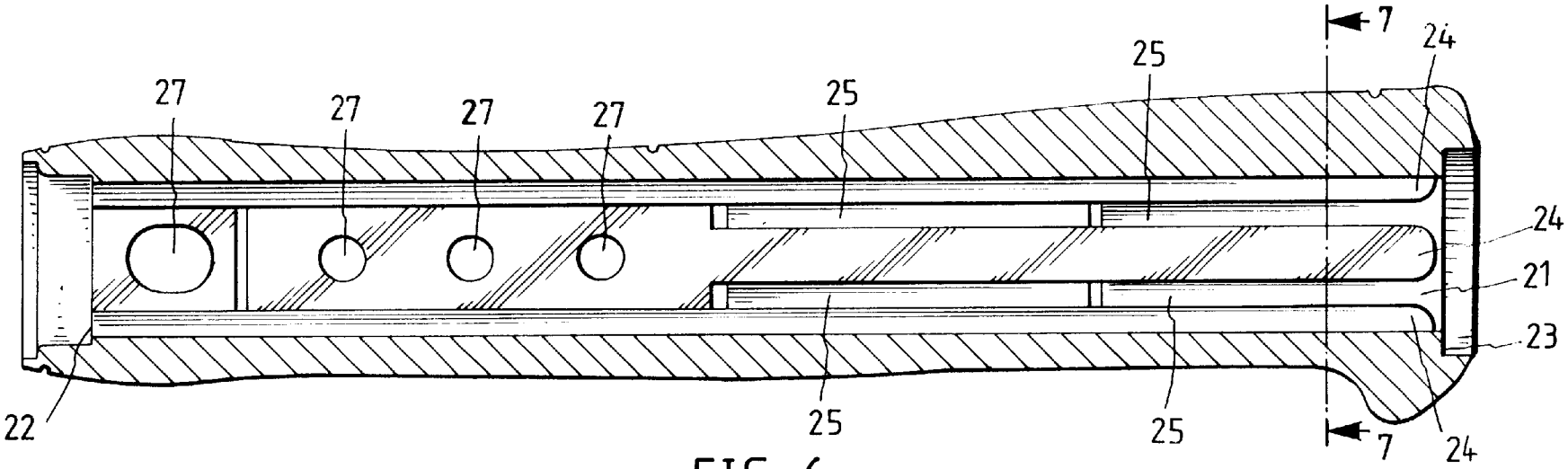
FIG. 6 is an axially sectional view of the grip of FIG. 5.

Referring to FIG. 3 and also referring to FIGS. 4, 5 and 6, the grip 20 is softer and slipproof. The grip 20 is formed with an axial central tunnel 21. The front end of the tunnel 21 is formed with a step face 22, while the rear end thereof is formed with a stop face 23. The inner wall face of the tunnel 21 is provided with splines 24, whereby the rear section of the tunnel 21 has a differential cross-section (as shown in FIG. 7 ). The two opposite wall faces of the tunnel 21 are formed with stepped stop channels 25 beside the splines 24. A holding section 26 is disposed on outer face of rear portion of the grip 20. Two sides of front portion of the grip 20 are formed with several stepped holes 27. An equal number of retaining bolts 28 are oppositely passed through the stepped holes 27 and fitted with each other and locked on the grip 20.

Figure 10:
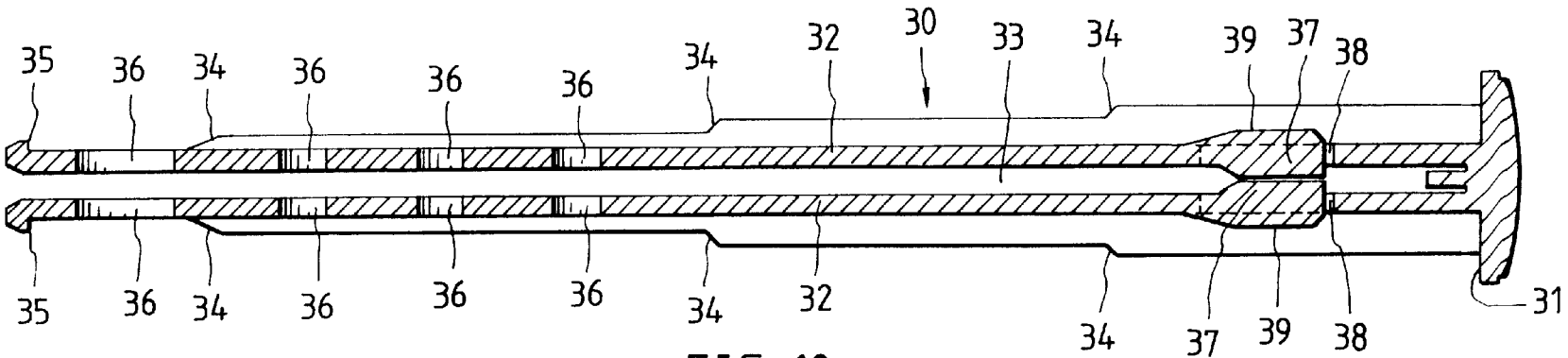
FIG. 10 is a longitudinally sectional view of the wedge retainer of FIG. 9.
Figure 8:
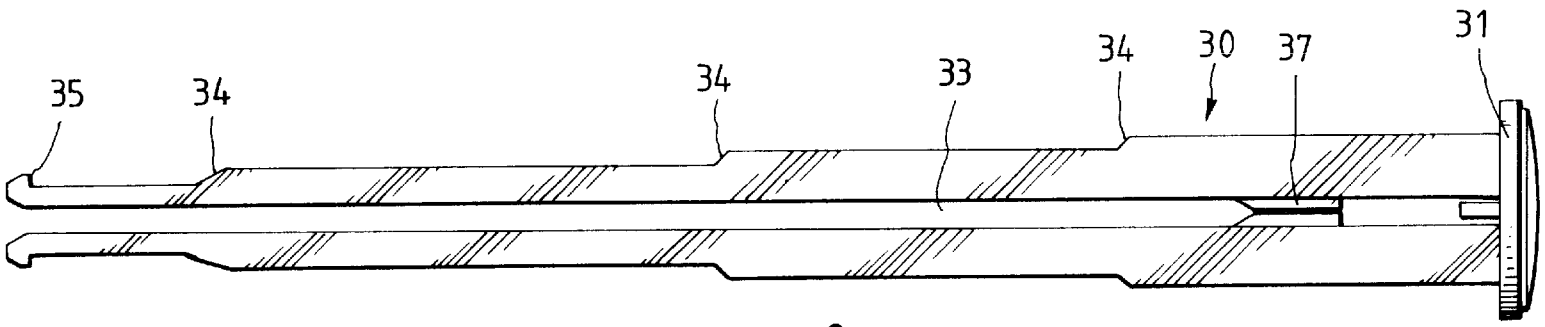
FIG. 8 is a plane view of the wedge retainer of the present invention.
Figure 9:
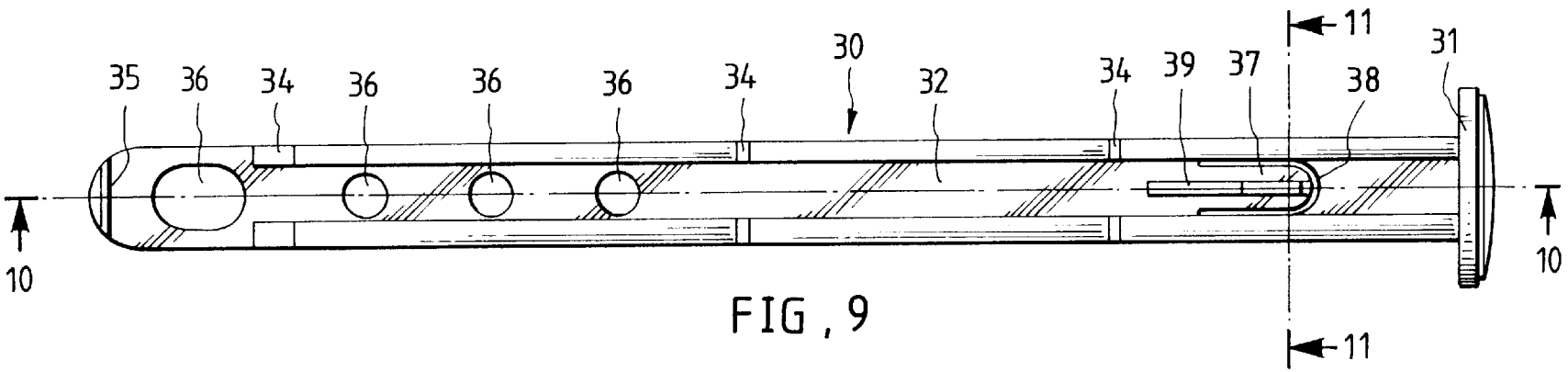
FIG. 9 is a side view of the wedge retainer of FIG. 8.

Referring to FIG. 3 and also referring to FIGS. 8, 9 and 10, the wedge retainer 30 is made by plastic integral injection molding. The wedge retainer 30 is harder for retaining the connecting bar 12 of the hammerhead 10 in the tunnel 21 of the grip 20. The rear end of the wedge retainer 30 is provided with a stop section 31. The outer circumferential face of the stop section 31 is snugly engaged with the stop face 23 of the rear end of the grip 20. Two opposite clamping plates 32 project from the stop section 31. The clamping plates 32 define therebetween a split 33 for the connecting bar 12 of the hammerhead 10 to insert therein. The top and bottom sides of each clamping plate 32 are provided with tapered stepped stop teeth 34. As shown in FIG. 11, the cross-section of the wedge retainer 30 is composed of two substantially -shapes mated with each other. The front ends of the two clamping plates 32 are respectively formed with hook sections 35. The front portion of each clamping plate 32 is formed with several through holes 36 corresponding to the locating holes 14 of the hammerhead 10 and the stepped holes 27 of the grip 20. In addition, near the stop section of the wedge retainer 30, the clamping plates 32 are respectively formed with two resilient snap tongues 37 abutting against each other. The snap tongue 37 is defined by a U-shaped slit 38 and has resiliently restoring force. The outer face of the snap tongue 37 is formed with reinforcing rib 39 for enhancing the resiliently restoring force thereof.

As shown in FIGS. 12 and 13, with the hook sections 35 directed forward, the wedge retainer 30 is fitted from the rear end of the grip 20 into the tunnel 21. The hook sections 35 hook the step face 22 of front end of the grip 20 and the stop section 31 of the wedge retainer 30 is leant against and located on the stop face 23 of the rear end of the tunnel 21. The stepped stop teeth 34 of the clamping plates 32 are engaged in the stepped stop channels 25 beside of the splines 24 in the tunnel 21, whereby the wedge retainer 30 is restricted and located in the tunnel 21 of the grip 20. At this time, the connecting bar 12 of the hammerhead 10 is fitted into the split 33 of the two clamping plates 32 of the wedge retainer 30 in the tunnel 21. When the end of the connecting bar 12 is inserted between the snap tongues 37 of the wedge retainer 30, the snap tongues 37 are slightly forcedly biased open. After the locating hole 13 of the connecting bar 12 is aligned with the snap tongues 37, the snap tongues 37 resiliently restore and snap into the locating hole 13 to abut against each other again. Accordingly, the connecting bar 12 is located in the split 33 between the clamping plates 32 and retained by the snap tongues 37. At this time, the locating holes 14 of the hammerhead 10 are aligned with the through holes 36 of the wedge retainer 30 and the stepped holes 27 of the grip 20. The retaining bolts 28 are then passed therethrough and locked thereon. The holding section 26 of the rear portion of the grip 20 is free from any retaining bolt so that a user can more easily and comfortably hold the grip 20. The connecting bar 12 of the hammerhead 10 is easily inserted into the grip 20 and retained by the wedge retainer 30. Such measure more firmly connects the hammerhead 10 with the grip 20.

The above embodiment is only used to illustrate the present invention, not intended to limit the scope thereof. Many modifications of the above embodiment can be made without departing from the spirit of the present invention.

What is claimed is:

1. Connecting structure for a hammerhead and a grip, comprising a hammerhead, a grip and a wedge retainer, the hammerhead having a connecting bar formed with locating holes for connecting with the grip and the wedge retainer, said connecting structure being characterized in that:

the grip is formed with an axial tunnel, one end of the tunnel being formed with a step face, while the other end thereof being formed with a stop face, both sides of the grip being formed with several stepped through holes near the step face;

one end of the wedge retainer is provided with hook sections, while the other end thereof is provided with a stop section, two opposite clamping plates symmetrically projecting from the stop section, the clamping plates defining therebetween a split for the connecting bar of the hammerhead to insert therein, near the stop section of the wedge retainer, the clamping plates being respectively formed with resilient snap tongues abutting against each, each clamping plate being formed with several through holes near the hook section; and the wedge retainer is fitted into the tunnel of the grip with the hook sections hooking the step face of one end of the grip and with the stop section of the wedge retainer leant against the stop face of the other end of the tunnel, the connecting bar of the hammerhead being inserted into the split of the two clamping plates of the wedge retainer in the tunnel, whereby the snap tongues resiliently snap into the locating hole of the connecting bar to locate the connecting bar in the split and thus the hammerhead is retained by the wedge retainer and connected with the grip.

2. Connecting structure for a hammerhead and a grip as claimed in claim 1, wherein an inner wall face of the tunnel of the grip is provided with splines for locating the connecting bar and the wedge retainer inserted in the tunnel.

3. Connecting structure for a hammerhead and a grip as claimed in claim 1, wherein stepped stop channels are formed on inner wall face of the tunnel of the grip beside the splines and lateral sides of each clamping plate are provided with stepped stop teeth, whereby when the wedge retainer is inserted into the tunnel of the grip, the stepped stop teeth of the clamping plates are engaged in the stepped stop channels to enlarge the stop area for the wedge retainer so as to more firmly connect the hammerhead with the grip.

4. Connecting structure for a hammerhead and a grip as claimed in claim 1, wherein the snap tongue is defined by a U-shaped slit and the surface of the snap tongue is formed with reinforcing ribs, after the wedge retainer is inserted into the tunnel, the reinforcing ribs abutting against the wall face of the tunnel, whereby when the snap tongues are forcedly biased open by the connecting bar, the reinforcing ribs enhance the resiliently restoring force of the snap tongues.

5. Connecting structure for a hammerhead and a grip as claimed in claim 1, wherein the front ends of the grip and the wedge retainer are respectively formed with stepped holes and through holes, retaining bolts being transversely passed through the stepped holes of the grip and the locating holes of the connecting bar and the through holes of the wedge retainer and locked thereon, whereby the connecting bar is more firmly connected with the grip, a holding section of rear portion of the grip being free from any retaining bolt so that a user can more easily and comfortably hold the grip.

* * * * *